US007933543B2

(12) United States Patent
Yoshioka et al.

(10) Patent No.: US 7,933,543 B2
(45) Date of Patent: Apr. 26, 2011

(54) IMAGE FORMING APPARATUS WITH CLEANING MODE

(75) Inventors: Mahito Yoshioka, Numazu (JP); Daizo Fukuzawa, Mishima (JP); Noriaki Sato, Suntou-gun (JP); Tooru Imaizumi, Kawasaki (JP); Munehito Kurata, Mishima (JP); Kuniaki Kasuga, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 12/418,196

(22) Filed: Apr. 3, 2009

(65) Prior Publication Data

US 2009/0257793 A1 Oct. 15, 2009

(30) Foreign Application Priority Data

Apr. 9, 2008 (JP) ..... 2008-101396
Mar. 30, 2009 (JP) ..... 2009-083242

(51) Int. Cl.
*G03G 15/20* (2006.01)

(52) U.S. Cl. ..... 399/327

(58) Field of Classification Search ..... 399/327
See application file for complete search history.

(56) References Cited

FOREIGN PATENT DOCUMENTS

| | | | |
|---|---|---|---|
| JP | 2651232 | B2 | 9/1997 |
| JP | H10-111619 | A | 4/1998 |
| JP | 3292568 | B2 | 6/2002 |
| JP | 2004-240447 | A | 8/2004 |

*Primary Examiner* — Hoang Ngo

(74) *Attorney, Agent, or Firm* — Fitzpatrick, Cella, Harper & Scinto

(57) ABSTRACT

The image forming apparatus includes an image forming portion forming a toner image on a recording material, and a fixing portion heating and fixing the toner image formed on the recording material to the recording material, wherein the apparatus has a cleaning mode in which the fixing portion is cleaned, and when the cleaning mode is set, the image forming portion forms a predetermined toner image on the recording material, and the fixing portion then heats and fixes the predetermined toner image to the recording material to form a cleaning sheet which is heated and conveyed to clean the fixing portion. By the virtue of the present invention, it achieves high cleaning performance in which the fixing portion is cleaned by the cleaning sheet.

10 Claims, 5 Drawing Sheets

IMAGE FORMING APPARATUS WITH CLEANING MODE

BACKGROUND OF THE INVENTION

1. Field of the Invention

The present invention relates to an image forming apparatus that forms color images on recording materials.

2. Description of the Related Art

Image forming apparatuses such as electrophotographic copiers and printers use a transfer unit to transfer a toner image borne on a photosensitive drum or an intermediate transfer member serving as an image bearing member, to a recording material. A fixing apparatus (fixer) then heats and presses the recording material to heat and fix the unfixed toner image to the recording material.

In the fixing apparatus, as the image forming apparatus is used over time, significant amounts of toner on the unfixed toner image or paper dust from a recording paper as a recording material may adhere to the outer peripheral surface (surface) of any component roller to contaminate the component roller surface. The adhesion results from an electrostatic offset caused by a charged recording material or component roller, a thermal offset caused by excessive or insufficient fixation, adhesion of the unfixed toner to the component roller surface during an operation of removing a jammed recording material, or paper dust falling from a recording material with a low surface strength. Upon exceeding the limit of accumulation on the surface of the component roller, the dirt or dust on the component roller surface is ejected onto the recording material through a nip portion to contaminate and damage the image on the recording material. Furthermore, the contamination of the component roller surface causes the recording material to be easily wound around the component roller surface. This may result in a jam in the fixing apparatus or damage to the component roller.

To solve these problems, the present applicant has proposed an image forming apparatus configured to clean the contaminated surface of a component roller (Japanese Patent No. 2651232). The image forming apparatus produces, as a cleaning sheet, a recording material with a toner pattern formed thereon and dedicated to cleaning. The image forming apparatus re-feeds the cleaning sheet so that the toner pattern on the cleaning sheet comes into contact with the component roller to be cleaned. The component roller surface is thus cleaned.

If a recording material containing a large amount of filler such as calcium carbonate or talc is passed through (introduced into) the nip portion, the filler adheres to the component roller surface to degrade the releasability of the component roller surface. Thus, the contamination of the component roller surface with toner or paper dust is rapidly deteriorated, with the level of the contamination increased. Under these conditions, even though the above-described cleaning is performed, the contamination of the component roller surface may not be easily removed by one cleaning operation.

To solve these problems, a plurality of pages of cleaning sheets may be passed through the nip portion or the cleaning operation may be frequently performed. However, undesirably, this may hinder normal image formation (printing) over a long time, or many recording materials may need to be used for the cleaning action.

SUMMARY OF THE INVENTION

The present invention has been made in view of the above-described problems. An object of the present invention is to provide an image forming apparatus that exhibits high performance in cleaning a fixing portion using a cleaning sheet, and a fixing portion cleaning method.

Another object of the present invention is to provide an image forming apparatus forming a color toner image and including:

an image forming portion that forms a toner image on a recording material; and a fixing portion that heats and fixes the toner image formed on the recording material to the recording material;

wherein said image forming apparatus includes a cleaning mode in which the fixing portion is cleaned, when the cleaning mode is set, the image forming portion forms a predetermined toner image on the recording material, and then the fixing portion heats and fixes the predetermined toner image to the recording material to form a cleaning sheet which is heated and conveyed at the fixing portion to clean the fixing portion;

wherein a toner amount per unit area to form the predetermined toner image on the recording material is larger than maximum amount of toner that is capable of being placed in the unit area on the recording material during a time for forming a normal image by means of only black toner.

Yet another object of the present invention is to provide a method of cleaning a "fixing portion provided on an image forming apparatus forming a color toner image", the method including; forming a predetermined toner image on the recording material;

heating and fixing the predetermined toner image to the recording material to form a cleaning sheet; and heating and conveying the cleaning sheet with the toner image fixed thereto to clean the fixing portion;

wherein a toner amount per unit area to form the predetermined toner image on the recording material is larger than a maximum amount of toner that can be placed in the unit area on the recording material during a time for forming a normal image by means of only black toner.

Other objects of the present invention will be made clear by reading the detailed description below with reference to the accompanying drawings.

Further features of the present invention will become apparent from the following description of exemplary embodiments with reference to the attached drawings.

DESCRIPTION OF THE EMBODIMENTS

The present invention will be described with reference to the drawings.

Exemplary Embodiment 1

(1) Example of the Color Image Forming Apparatus

Figure 1:
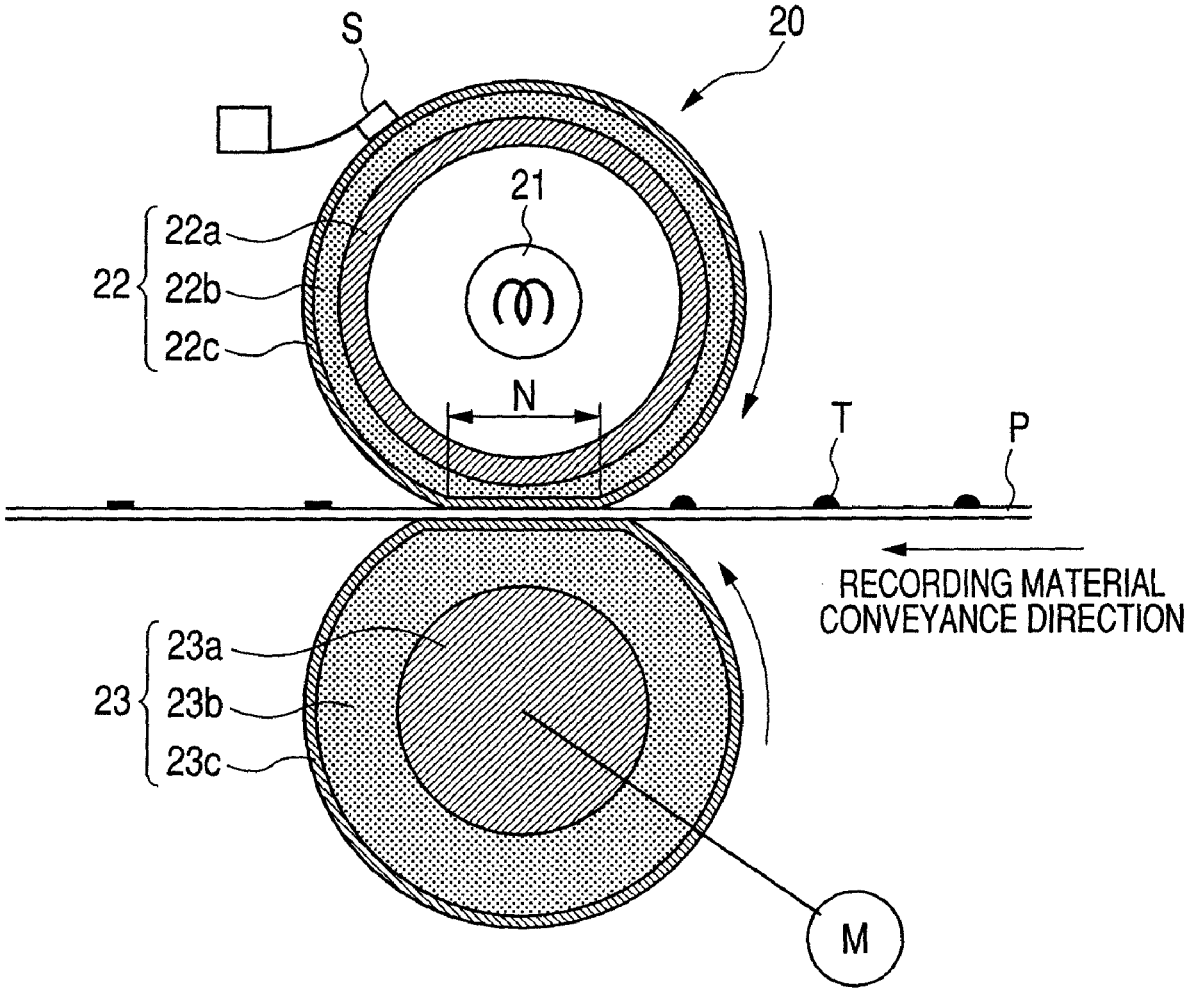
FIG. 1 is a sectional view of a fixing portion provided on an image forming apparatus according to the present invention.

FIG. 1 is a schematic diagram illustrating an example of the construction of a color image forming apparatus according to Exemplary Embodiment 1. The color image forming apparatus is a full color laser printer that uses an electrophotographic scheme to superimpose toner images in four colors, that is, yellow, cyan, magenta, and black, on one another to obtain a full color image.

The color image forming apparatus illustrated in the present exemplary embodiment has conveying units 12 and 24 conveying a recording material P, and four image forming stations 41Y, 41C, 41M and 41K substantially linearly arranged in a vertical direction. In the present exemplary embodiment, the four image forming stations are collectively referred to as an image forming portion. The color image forming apparatus also has a heating and fixing apparatus (fixing portion) 20, a control portion 100 as a control unit, and a video controller 101 that forms image signals for image formation.

The control portion 100 is made up of memories such as a ROM and a RAM, and a CPU. The memories store an image forming control sequence that allows images to be formed on the recording material P and a cleaning control sequence that allows the heating and fixing apparatus 20 to be cleaned.

The image forming station 41Y, one of the four image forming stations 41Y, 41C, 41M and 41K, is a yellow image forming station that forms yellow (hereinafter abbreviated to Y) images. The image forming station 41C is a cyan image forming station that forms cyan (hereinafter abbreviated to C) images. The image forming station 41M is a magenta image forming station that forms magenta (hereinafter abbreviated to M) images. The image forming station 41K is a black image forming station that forms black (hereinafter abbreviated to B) images.

The image forming stations 41Y, 41C, 41M and 41K have electrophotographic photosensitive members (hereinafter referred to as photosensitive drums) 1Y, 1C, 1M and 1K, respectively, which are drum-shaped image bearing members, and charging rollers 3Y, 3C, 3M and 3K, respectively, serving as charging units. The image forming stations 41Y, 41C, 41M and 41K also have image developing apparatuses 2Y, 2C, 2M and 2K as developing units, and cleaners 4Y, 4C, 4M and 4K serving as cleaning units.

The photosensitive drum 1Y, the charging roller 3Y, the developing apparatus 2Y and the cleaner 4Y are housed in one frame to make up a yellow cartridge Y. The photosensitive drum 1C, the charging roller 3C, the developing apparatus 2C and the cleaner 4C are housed in one frame to make up a cyan cartridge C. The photosensitive drum 1M, the charging roller 3M, the developing apparatus 2M and the cleaner 4M are housed in one frame to make up a magenta cartridge M. The photosensitive drum 1K, the charging roller 3K, the developing apparatus 2K and the cleaner 4K are housed in one frame to make up a black cartridge K. Yellow toner is housed in the developing apparatus 2Y in the yellow cartridge Y. Cyan toner is housed in the developing apparatus 2C in the cyan cartridge C. Magenta toner is housed in the developing apparatus 2M in the magenta cartridge M. Black toner is housed in the developing apparatus 2K in the black cartridge K.

A laser scanning exposure apparatus (hereinafter referred to as an exposure apparatus) 5 serves as an exposure unit. The exposure apparatus 5 is provided in association with the cartridges Y, C, M and K. The photosensitive drums 1Y, 1C, 1M and 1K for the cartridges Y, C, M and K, respectively, are exposed to form electrostatic latent images on the respective photosensitive drums.

An intermediate transfer belt (intermediate transfer member) 6 is an endless belt-like image bearing member. The intermediate transfer belt 6 is provided along a direction in which the image forming stations 41Y, 41C, 41M and 41K are arranged. The intermediate transfer belt 6 is passed around three rollers, that is, a driving roller 7, a tension roller 8 and a secondary transfer opposite roller 14. The intermediate transfer belt 6 is driven by the driving roller 7 so as to move circularly along the photosensitive drums 1Y, 1C, 1M and 1K of the image forming stations 41Y, 41C, 41M and 41K in the direction of an illustrated arrow.

Primary transfer rollers 9Y, 9C, 9M and 9K are used as primary transfer units that transfer toner images on the surfaces of the photosensitive drums 1Y, 1C, 1M and 1K, to the outer peripheral surface (surface) of the intermediate transfer belt 6. The primary transfer rollers 9Y, 9C, 9M and 9K are disposed opposite the photosensitive drums 1Y, 1C, 1M and 1K across the intermediate transfer belt 6.

A collection roller 15 serves as a cleaning unit for the intermediate transfer bent 6. The collection roller 15 is provided opposite the intermediate transfer belt 6 between the secondary transfer roller 14 and the yellow image forming station 41Y.

The conveying unit has a feeding roller 11, a registration roller 12, a discharging roller 24, a reversing roller 25 and a double-side printing conveyance path 26. The double-side printing conveyance path 26 has the function of conveying (re-feeding) a cleaning sheet to the fixing portion 20.

Upon receiving image data from an external apparatus (not illustrated in the drawings) such as a host computer, the video controller 101 transmits a print signal to the control unit 100 and converts the received image data into bit map data. Upon receiving the print signal, the control unit carries out the image forming control sequence. When the image forming control sequence is carried out, first, the photosensitive drums 1Y, 1C, 1M and 1K are rotated in the direction of an illustrated arrow. The outer peripheral surfaces (surfaces) of the photosensitive drums 1Y, 1C, 1M and 1K are uniformly charged to a predetermined polarity and a predetermined potential by the charging rollers 3Y, 3C, 3M and 3K, respectively. In the present exemplary embodiment, the surfaces of the photosensitive drums 1Y, 1C, 1M and 1K are charged to a negative polarity. The exposure apparatus 5 scans and exposes the charged surfaces of the photosensitive drums 1Y, 1C, 1M and 1K to laser light corresponding to an image signal that depends on bit map data. Electrostatic latent images corresponding to the image data are formed on the charged surfaces of the respective photosensitive drums 1Y, 1C, 1M and 1K. Each of the developing apparatuses 2Y, 2C, 2M and 2K sets a developing bias applied to a corresponding one of developing rollers 21Y, 21C, 21M and 21K by a developing bias power source (not illustrated in the drawings), to an appropriate value between a charging potential and a latent image (exposure portion) potential. Thus, the toner charged to the negative polarity adheres to each exposure portion to form a toner image on the corresponding photosensitive drum.

The single-color toner images developed on the surfaces of the photosensitive drums 1Y, 1C, 1M and 1K by the developing apparatuses 2Y, 2C, 2M and 2K, respectively, are transferred to the outer peripheral surface (surface) of the intermediate transfer belt 6, which rotates at a substantially uniform speed, in synchronism with rotation of the photosensitive drums 1Y, 1C, 1M and 1K. That is, first transfer bias power sources V1Y, V1C, V1M and V1K (not illustrated in the drawings) apply transfer biases of a positive polarity, which is opposite to the polarity of the toner, to primary transfer rollers 9Y, 9C, 9M and 9K corresponding to the photosensitive drums 1Y, 1C, 1M and 1K, respectively. Thus, the toner images in the respective colors are primarily superimposedly transferred from the surfaces of the photosensitive drums 1Y, 1C, 1M and 1K to the surface of the intermediate transfer belt 6. Correspondingly, a color toner image is borne on the surface of the intermediate transfer belt 6.

After the primary transfer of the toner images, transfer contaminating toner remaining on the surfaces of the photosensitive drums 1Y, 1C, 1M and 1K is removed by cleaning members 41Y, 41C, 41M and 41K provided on the cleaners 4Y, 4C, 4M and 4K, respectively. The transfer contaminating toner removed by the cleaning members 41Y, 41C, 41M and 41K is collected in waste toner containers (not illustrated in the drawings) provided in the cleaners 4Y, 4C, 4M and 4K, respectively. In the present exemplary embodiment, cleaning blades made of urethane blades are used as the cleaning members.

As described above, a charging step using the charging rollers, an exposure step using the exposure apparatus, a developing step using the developing members, and a primary transfer step using the primary transfer rollers 9 are carried out on each of the colors, that is, yellow, magenta, cyan and black in synchronism with the rotation of the intermediate transfer belt 6. Thus, the toner images in the respective colors are formed on the surface of the intermediate transfer belt 6 by being sequentially superimposed on one another.

On the other hand, the recording material P set in a recording material cassette 10 serving as a recording material supply portion is fed by the feeding roller 11. The leading end of the recording material P is detected by a top sensor S1 provided immediately after the registration roller 12. In response to the detection of the leading end of the recording material P by the top sensor S1, the registration roller 12 conveys the recording material P to a transfer nip portion between the intermediate transfer belt 6 and a secondary transfer roller 13 serving as a secondary transfer unit, in the right timing for the position of the image on the surface of the intermediate transfer belt 6. The transfer nip portion is formed between the intermediate transfer belt 6 and the secondary transfer roller 13 by placing the secondary transfer roller 13 in contact with the surface of the secondary transfer belt 6 at a position where the secondary transfer roller 13 lies opposite the secondary transfer opposite roller 14. The conveyance speed of the recording material P in the image forming apparatus according to the present exemplary embodiment is 180 mm/sec.

When a second transfer bias power source V2 (not illustrated in the drawings) applies a bias of the polarity opposite to that of the toner to the secondary transfer roller 13, the color toner image borne on the surface of the intermediate transfer belt 6 is transferred onto the recording material P at a time (secondary transfer).

The color toner image T transferred onto the recording material P is introduced into a nip portion (fixing nip portion) of a heating and fixing apparatus (fixer) 20 serving as a fixing unit. The color toner image T is then heated and pressurized and thus fixed on the recording material P. The recording material P exits the nip portion N of the heating and fixing apparatus (hereinafter referred to as a fixing apparatus) 20 and is then discharged onto a discharging tray by the discharging roller pair 24.

After the transfer of the color toner image T, the transfer residual toner remaining on the surface of the intermediate transfer belt 6 is electrostatically collected and accumulated on the outer peripheral surface (surface) of the collection roller 15 to which a bias of the positive polarity is applied by a third transfer bias power source V3 (not illustrated in the drawings). Moreover, the secondary transfer operation is performed for a predetermined number of pages. Then, the image forming operation is suspended. A bias of the negative polarity is then applied to the collection roller 15 by the third transfer bias power source V3. Thus, the transfer residual toner remaining on the surface of the collection roller 15 is electrostatically discharged from the surface of the collection roller 15 to the surface of the intermediate transfer belt 6. At the same time, an electric field is formed in a primary transfer portion between the photosensitive drum 1Y of the yellow image forming station 41Y and the intermediate transfer belt 6 such that the transfer residual toner on the surface of the intermediate transfer belt 6 is reversely transferred from the surface of the intermediate transfer belt 6 to the surface of the photosensitive drum 1Y. For example, the surface of the photosensitive drum 1Y is set to −100 V. A transfer bias of −300 V is applied to the transfer roller 9Y by the first transfer bias power source V1Y to reversely transfer the transfer residual toner on the surface of the intermediate transfer belt 6 to the surface of the photosensitive drum 1Y. The transfer residual toner reversely transferred to the surface of the photosensitive drum 1Y is finally removed from the surface of the photosensitive drum 1Y by the cleaning member 42Y. The transfer residual toner is then collected in a waste toner container.

(2) Fixing Apparatus

Figure 2:
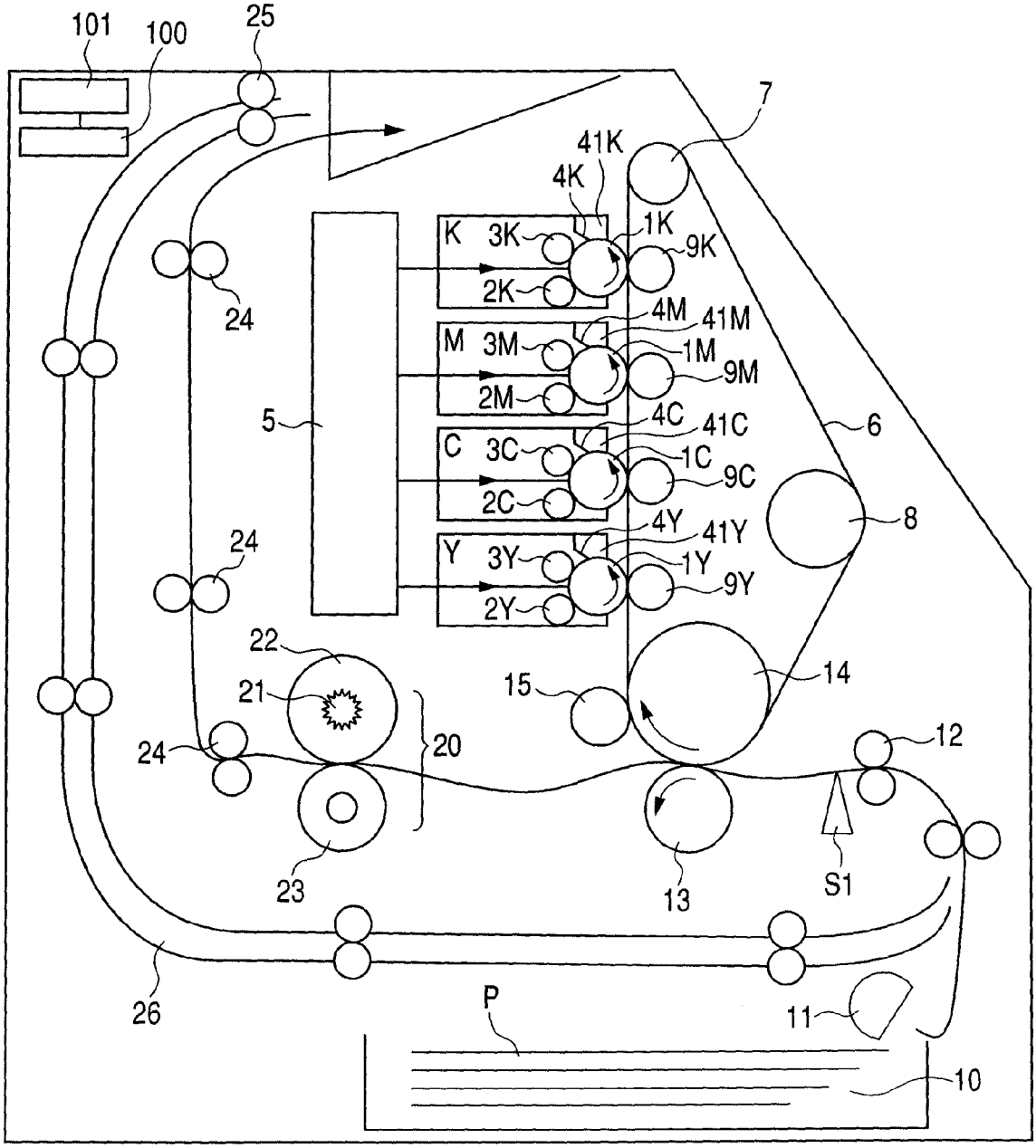
FIG. 2 is a sectional view of the image forming apparatus according to the present invention.

FIG. 2 is a schematic transversely sectional view of an example of the fixing apparatus 20. The fixing apparatus 20 is based on a heated roller scheme.

In the description below, in connection with the fixing apparatus and the members making up the fixing apparatus, a longitudinal direction is orthogonal to a recording material conveyance direction on the surface of the recording material. A latitudinal direction is parallel with the recording material conveyance direction on the surface of the recording material. Width is a dimension in the latitudinal direction.

The fixing apparatus (fixing portion) 20 has a halogen lamp 21 serving as a heating unit, and a fixing roller 22 and a pressure roller 23 both serving as a fixing member. The halogen lamp 21, the fixing roller 22, and the pressure roller 23 are all elongate in the longitudinal direction.

The fixing roller 22 has a cylindrical hollow core bar 22*a* made of aluminum or stainless steel. An elastic layer 22*b* that is thinned silicone rubber is formed on the outer peripheral surface of the hollow core bar 22*a*. Moreover, a releasing layer 22*c* made up of polytetrafluoroethylene (PTFE) or a perfluoroalkoxy tetrafluoroethylene (PFA) copolymer and exhibiting high releasability is formed on the outer peripheral surface of the elastic layer 22*b*. The longitudinally opposite ends of the hollow core bar 22*a* of the fixing roller 22 are rotatably held on an apparatus frame (not illustrated in the drawings).

The halogen lamp 21 is disposed inside the hollow core bar 22*a* of the fixing roller 22. The longitudinally opposite ends of the halogen lamp 21 are held on the apparatus frame. The halogen lamp 21 is energized by a power source (not illustrated in the drawings) to generate heat. Radiation heat from the halogen lamp 21 heats the outer peripheral surface (surface) of the fixing roller from the interior of the hollow core bar 22*a* via the hollow core bar 22*a*, the elastic layer 22*b* and the releasing layer 22*c*.

The pressure roller 23 has a round shaft-like core bar 23*a* made of aluminum or stainless steel. An elastic layer 23*b* that is thickened silicone rubber or foaming silicone rubber is formed on the outer peripheral surface of the core bar 23*a*. Moreover, a releasing layer 23*c*made up of PTFE or PFA is formed on the outer peripheral surface of the elastic layer 23*b* as an outermost layer. The pressure roller 23 is disposed substantially parallel with the fixing roller 22. The longitudinally opposite ends of the core bar 23*a* are rotatably held on the apparatus frame. The longitudinally opposite ends of the core bar 23*a* of the pressure roller 23 are biased in the axial direction of the fixing roller 22 by a pressure unit (not illustrated in the drawings) such as a pressure spring. The outer surface (surface) of the pressure roller 23 is thus contacted with the surface of the fixing roller 22 under pressure. The elastic layer 23*b* of the pressure roller 23 is elastically deformed along the longitudinal direction of the surface of the fixing roller 22 by the pressure applied by the pressure unit. Thus, a nip portion (fixing nip portion) N with a predetermined width is formed between the surface of the pressure roller 23 and the surface of the fixing roller 22.

(3) Heating and Fixing Operation by the Fixing Apparatus

In response to an input print signal, the control portion 100 allows a fixing motor M (FIG. 2) serving as a driving source to rotationally drive a driving gear (not illustrated in the drawings) provided at one end of the core bar 23*a* of the pressure roller 23. The pressure roller 23 is thus rotated in the direction of an illustrated arrow. The rotation of the pressure roller 23 causes a rotational force to act on the fixing roller 22 in association with the frictional force between the surface of the pressure roller 23 and the surface of the fixing roller 22. The rotational force allows the fixing roller 22 to rotate in conjunction with the rotation of the pressure roller 23 in the direction of an arrow in the figure at the same peripheral speed as that of the pressure roller 23.

Furthermore, the control portion 100 turns on a triac (not illustrated in the drawings) serving as an energization control unit. Thus, the halogen lamp 21 is energized by the power source (not illustrated in the drawings). When energized, the halogen lamp 21 generates radiation heat to heat the hollow core bar 22*a* of the fixing roller 22. The heat from the hollow core bar 22*a* is transmitted to the releasing layer 22*c* through the elastic layer 22*b*. The temperature of the surface of the fixing roller 22 is thus raised. The temperature of the surface of the fixing roller 22 is detected by a temperature detecting unit S such as a thermistor located in contact with or separately from the surface of the fixing roller 22. The control portion 100 receives an output signal (temperature detection signal) from the temperature detecting unit S. Based on the output signal, the control portion 100 then allows the triac to control power applied to the halogen lamp 21 so as to keep the temperature of the surface of the fixing roller 22 kept equal to a fixing temperature (target temperature). In the present exemplary embodiment, the fixing temperature is maintained at 190° C.

With the surface temperature of the fixing roller 22 kept equal to the fixing temperature and with the rotational peripheral speed of the fixing roller 22 resulting from the rotation of the pressure roller 23 maintained in a steady state, the recording material P bearing the unfixed color toner image T is introduced into the nip portion N. At the nip portion, the recording material P is pinched and conveyed by the surface of the fixing roller 22 and the surface of the pressure roller 23. The recording material P is thus subjected to heat from the surface of the fixing roller 22 and the pressure of the nip portion N. The color toner image T is thus heated and fixed on the recording material P.

(4) Description of the Cleaning Mode

Figure 3:
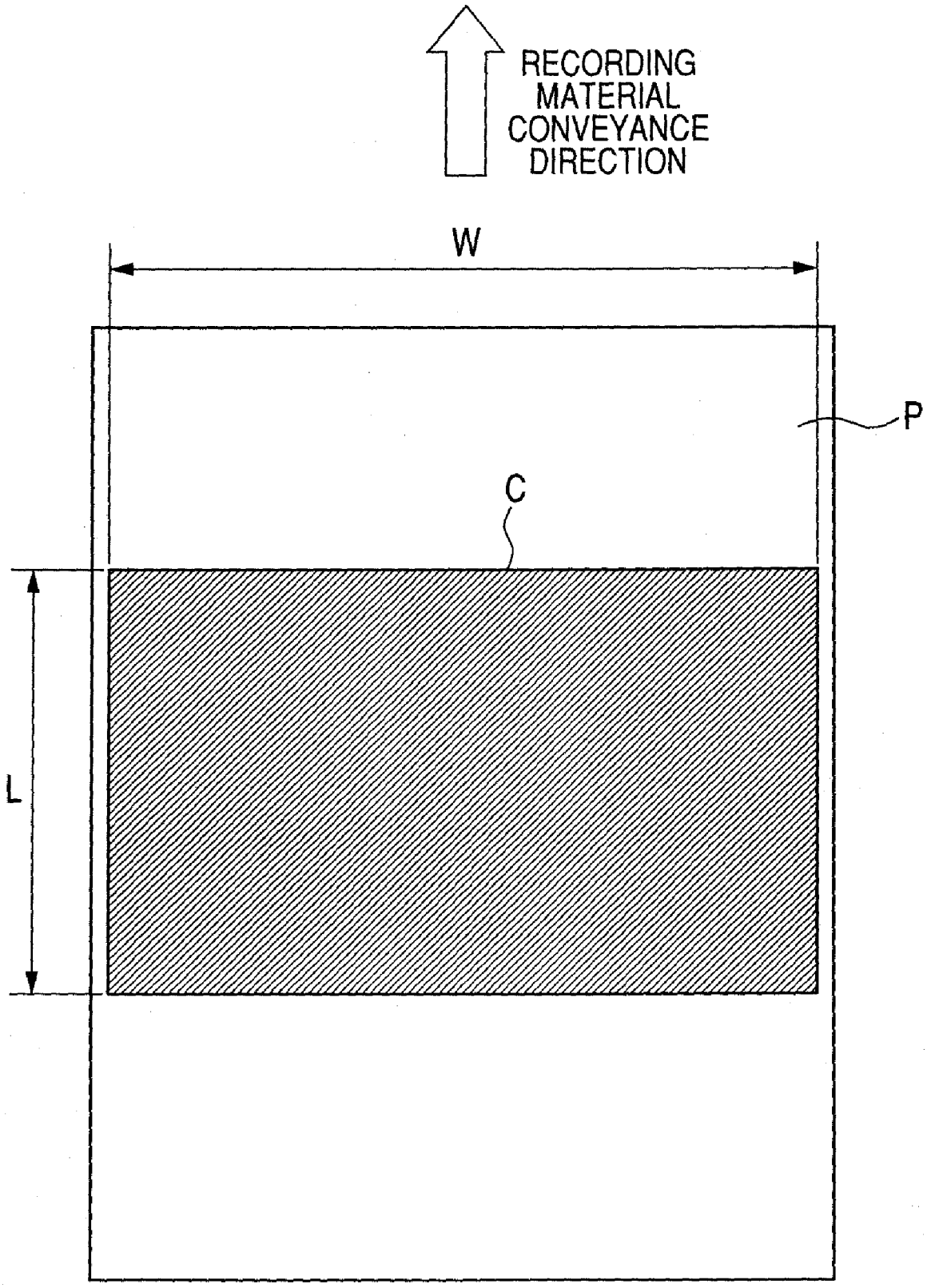
FIG. 3 is a diagram illustrating a cleaning sheet with a cleaning image pattern formed thereon.

Upon receiving an instruction for a cleaning mode from an external apparatus or an operation panel (not illustrated in the drawings) of the image forming apparatus, the control portion 100 carries out the cleaning control sequence. When the cleaning control sequence is carried out, first, a cleaning image pattern stored in the ROM is expanded. The same image forming operation as described above (normal image forming operation) is performed to form a cleaning toner image pattern on the recording material P. A cleaning sheet is thus produced. That is, at least predetermined two of the four image forming stations, provided in the image forming portion, are used to carry out the charging step using the charging rollers, the exposure step using the exposure apparatus, the developing step using the developing members, and the primary transfer step using the primary transfer rollers 9 in synchronism with the rotation of the intermediate transfer belt 6. Thus, the at least two predetermined image forming stations sequentially and superimposedly form toner images on the surface of the intermediate transfer belt 6. Consequently, an unfixed toner image pattern is borne on the surface of the intermediate transfer belt 6 using the toner in at least the two colors. On the other hand, a recording material P is fed from the feeding cassette 10 by the feeding roller 11. In response to the detection of the leading end of the recording material P by the top sensor S1, the recording material P is conveyed to the transfer nip portion by the registration roller 12 in the right timing for the position of the image on the surface of the intermediate transfer belt 6. A transfer bias is applied to the secondary transfer roller 13 by the second transfer bias power source V2 to transfer the unfixed toner image pattern (predetermined toner image) C (see FIG. 3) on the surface of the intermediate transfer belt 6, onto the recording material P. The toner image pattern is thus borne on the surface of the intermediate transfer belt 6. FIG. 3 is a diagram illustrating the unfixed toner image pattern C borne on the recording material P.

Furthermore, the control portion 100 turns on the triac. The halogen lamp 21 is thus energized to heat the surface of the fixing roller 22 to the fixing temperature. Furthermore, the fixing motor M is driven to rotate the pressure roller 23, thus rotating the fixing roller 22 in conjunction with the rotation of the pressure roller 23. The recording material P bearing the unfixed toner image pattern C is introduced into the nip portion N of the fixing apparatus 20. At the nip portion N, the recording material P is then pinched and conveyed by the fixing roller 22 and the pressure roller 23. The toner image pattern C is thus heated and fixed on the recording material P. Consequently, the toner image pattern C is formed on the recording material P. Then, the recording material P exits the nip portion N and is then discharged onto the discharging tray 25 by the discharging roller pair 24. To allow the fixing apparatus 20 to be cleaned using the recording material P, that is, the cleaning sheet with the predetermined toner image C formed thereon, the toner image pattern C-side surface of the recording material P is directed toward the fixing roller 22 to be cleaned. The recording material P is then re-fed to the nip portion N of the fixing apparatus 20 by the conveying unit (the feeding roller 11 and the registration roller 12). Alternatively, the toner image pattern C-side surface of the recording material P is directed toward the pressure roller 23 to be cleaned. The recording material P is then re-fed to the nip portion N of the fixing apparatus 20 by the conveying unit. To be distinguished from the recording material P not bearing the predetermined toner image C, the cleaning sheet is hereinafter denoted by reference character CP.

In the image forming apparatus according to the exemplary embodiment, the cleaning sheet CP with the toner image pattern C formed thereon is discharged to the exterior of the image forming apparatus. The cleaning sheet CP is then re-set in the recording material cassette 10 by the user of the image forming apparatus for re-feeding. In this case, when the fixing roller 22 is to be cleaned, the cleaning sheet CP is set in the recording material cassette 10 with the toner image pattern C facing downward. When the pressure roller 23 is to be cleaned, the cleaning sheet CP is set in the recording material cassette 10 with the toner image pattern C facing upward. A method of setting the cleaning sheet CP varies depending on the construction of the conveying unit. Thus, the user needs to be able to determine in which direction the toner image pattern C is to be directed when the cleaning sheet CP is re-set. To allow the user to make the determination, information on the set direction is desirably printed on the cleaning sheet CP together with the toner image pattern C. If the pressure roller 23 is to be cleaned, the inversion roller 25, provided close to the discharging tray 25, may be used to introduce the cleaning sheet CP into the double-side printing conveyance path 26. Then, the cleaning sheet CP may be turned inside out and then re-fed to the nip portion N. When the cleaning sheet CP is conveyed, the above-described formation of an image on the cleaning sheet CP by the image forming portion is not performed.

In the fixing apparatus based on the heated roller scheme, compared to the fixing roller 22, containing the heating halogen heater 21, the pressure roller 23 has a relatively low surface temperature. Consequently, the surface of the pressure roller 23 is likely to be contaminated with toner or paper dust. Thus, the cleaning sheet CP is re-fed with the toner image pattern C directed toward the pressure roller 23. Then, the contaminated surface of the pressure roller 23 can be cleaned utilizing the stickiness of the fixed toner image C.

The following is the reason why the surface of the fixing roller 22 or the pressure roller 23 can be cleaned by re-feeding the cleaning sheet CP with the toner image pattern C formed thereon. The toner image with the fixed toner image pattern C is reheated by the nip portion N and melted. Thus, paper dust sticks to the melted toner image pattern owing to the viscosity thereof. Furthermore, the melted toner image pattern is compatible with contaminating toner. Consequently, the contaminating toner is likely to stick to the melted toner image pattern. Thus, the surface of the fixing roller 22 or the pressure roller 23 can be cleaned by re-feeding the cleaning sheet CP with the toner image pattern C formed thereon in the direction of the fixing roller 22 or the pressure roller 23. That is, the fixing member can be cleaned by conveying the recording material with the toner image pattern surface of the recording material facing the fixing member, which is to be cleaned.

FIG. 3 is a diagram illustrating the toner image pattern C borne on the cleaning sheet CP.

The toner image pattern C is a solid image such as the one illustrated in FIG. 3. The length L of the solid image in the recording material conveyance direction is set equal to or larger than the circumference of the rotating member to be cleaned, that is, the fixing roller 22 or the pressure roller 23. In the present exemplary embodiment, the length L of the solid image in the recording material conveyance direction is set equal to or larger than one round of the pressure roller 23. This is to avoid leaving a non-cleaning area that cannot be cleaned by the solid image, on the surface of the pressure roller 23 to be cleaned. The length W of the solid image in the width direction thereof, which is orthogonal to the recording material conveyance direction, is set within the maximum range within which the fed recording material P can be printed and which is smaller than the width orthogonal to the recording material conveyance direction of the fed recording material P. This is to allow the pressure roller 23 to be cleaned over the maximum possible range in the longitudinal direction of the pressure roller 23.

Ordinary color image forming apparatuses have, as normal image forming modes, a monochrome image forming mode in which an image is formed using only the black toner and a full color image forming mode in which an image is formed using the four types of color toner. Furthermore, in the cleaning mode, the toner image pattern C is formed on the recording material using only the black toner.

Conventional color image forming apparatuses set the amount of toner provided on the recording material to form a cleaning image pattern, equal to or smaller than the maximum toner amount per unit area with which an image can be formed on the recording material in a normal image forming time using one of the plural types of color toner. That is, given the maximum amount of toner that can be placed in the unit area on the recording material in the monochrome image forming mode using only the black toner is defined to be 100%, the toner amount per unit area with which the toner image pattern C is formed on the recording material during a time for executing a cleaning mode (using only the black toner) is set to at most 100%.

The image forming apparatus according to the present exemplary embodiment uses at least two types of color toner to form the toner image pattern C on the recording material P. In this case, the toner amount per unit area for the unfixed toner image pattern C is set to exceed the maximum toner amount per unit area with which a monochrome image can be formed on the recording material in the normal image forming time in which the image forming control sequence is carried out to form the monochrome image on the recording material (monochrome image forming mode). The toner amount per unit area for the toner image pattern C can be set to exceed the maximum toner amount per unit area with which an image can be formed on the recording material in the normal image forming time in which the image is formed on the recording material using at least two types of color toner (full color image forming mode).

In particular, a color image forming apparatus such as a full color laser printer superimposes plural types of color toner on one another on the recording material P to form an image. This increases the toner amount per unit area on the recording material P. An increase in the toner amount per unit area on the recording material P may cause transfer problems such as an improper transfer and flying of an upper layer of toner from the color toner image superimposedly formed on the recording material. Furthermore, fixation problems may occur such as a blister caused by insufficient heating of a lower layer of toner in the color toner image superimposedly formed on the recording material. To prevent such problems, in the normal image forming time (monochrome image forming mode and full color image forming mode), toner development conditions are generally adjusted and controlled so as not to exceed the predetermined toner amount per unit area. For example, with the image forming apparatus according to the present exemplary embodiment, toner with a true specific gravity of 1.1 is used, and the amount of each type of color toner per unit area on the recording material P is set such that 0.45 mg/cm$^2$ of toner corresponds to 100%. That is, in the black image forming mode, the upper limit of the amount of toner that can be provided in the unit area on the recording material is 0.45 mg/cm$^2$. In the black image forming mode, a black toner image is formed on the photosensitive drum 1K so that the toner amount per unit area on the recording material does not exceed 0.45 mg/cm$^2$. Furthermore, when at least two types of toner are superimposed on one another to form an image (full color image forming mode), the maximum toner amount per unit area on the recording material P is 180%. That is, in the full color image forming mode, toner images are formed on the four photosensitive drums (1Y, 1C, 1M and 1K) so that the toner amount per unit area on the recording material with the four types of color toner superimposed on one another thereon does not exceed 0.81 mg/cm$^2$. Also in the full color image forming mode, the upper limit of the amount of toner that can be placed in the unit area on the recording material by each of the image forming stations is 100% (0.45 mg/cm$^2$). In the normal image forming mode (monochrome image forming mode and full color image forming mode), the video controller 101 sets the upper limit of the toner amount per unit area to one of 100% and 180%. That is, upon converting received image data into bit map data, the video controller 101 adjusts the maximum toner amount to one of 100% and 180%. The charging bias, applied to the charging roller, and the developing bias, applied to the developing roller, remain unchanged. The transfer bias, required to transfer toner images from the intermediate transfer belt to the recording paper, may be changed between the monochrome image forming mode and the full color image forming mode.

Furthermore, to form an image on the recording material P using only one of the plural types of color toner (black toner), the image forming apparatus performs control such that the maximum toner amount per unit area is 100%. Thus, when the image forming apparatus forms a solid image in the normal image forming time (monochrome image forming mode), the toner amount per unit area on the recording material is at most 100%. For the conventional image forming apparatuses, this setting is also used for the cleaning image pattern; the toner amount per unit area for the cleaning image pattern is also set to at most 100%.

The toner image pattern C on the recording material P, used in the cleaning mode, is not used as an image sample. Thus, the image quality of the toner image pattern C is negligible. On the other hand, the results of the present applicant's examinations indicate that the cleaning effect is improved by increasing the amount of toner for the toner image pattern C. This is expected to occur because the increased amount of toner allows the toner on the recording material to easily follow dirt and dust of various sizes on the surface of the fixing member to be cleaned, thus effectively wrapping the dirt and dust to improve the cleaning effect.

Furthermore, the increased amount of toner allows the surface of the toner image pattern C to be smoothed regardless of recesses and protrusions on the surface of the recording material P that is to be formed into the cleaning sheet CP. Thus, the toner image pattern C can be easily tightly contacted with the surface of the fixing member. Therefore, a high cleaning effect can be exerted regardless of the type of the recording material P to be formed into the cleaning sheet CP.

Figure 4:
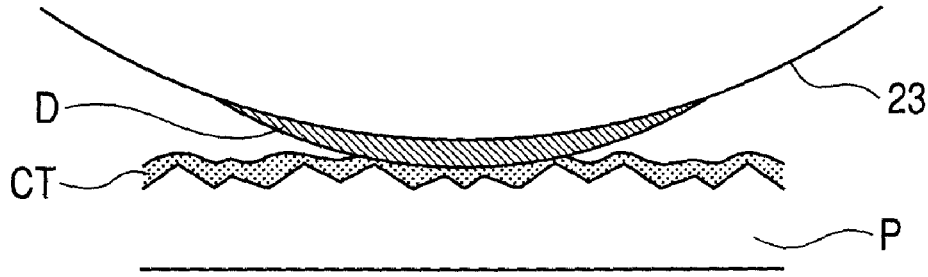
FIG. 4 is a schematic diagram illustrating the relationship between contaminating toner on a pressure roller and a cleaning image pattern having the same toner amount per unit area as that in the conventional art and borne on a recording material with a low surface roughness, wherein the cleaning image pattern is heated and fixed to the recording material, and the cleaning sheet is used to clean the pressure roller.
Figure 5:
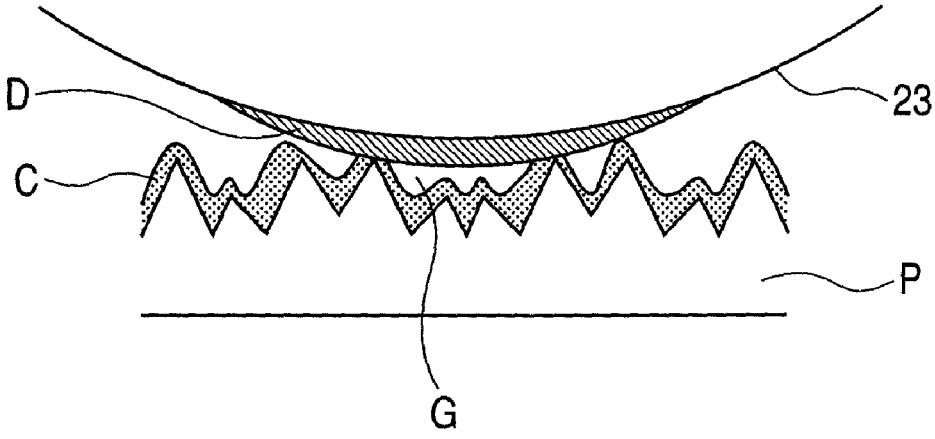
FIG. 5 is a schematic diagram illustrating the relationship between contaminating toner on the pressure roller and a cleaning image pattern having the same toner amount per unit area as that in the conventional art and borne on a recording material with a high surface roughness, wherein the cleaning image pattern is heated and fixed to the recording material, and the cleaning sheet is used to clean the pressure roller.
Figure 6:
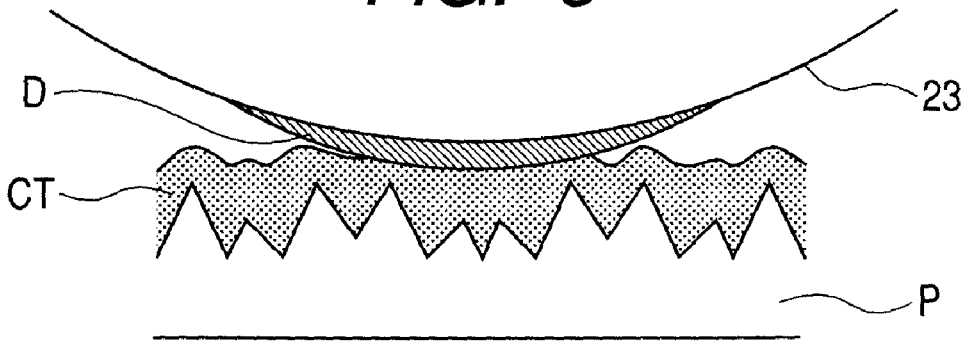
FIG. 6 is a schematic diagram illustrating the relationship between a contaminating toner on the pressure roller and a cleaning image pattern having a large toner amount per unit area and borne on a recording material with a high surface roughness, wherein the cleaning image pattern is heated and fixed to the recording material, and the cleaning sheet is used to clean the pressure roller.

FIGS. 4, 5 and 6 are schematic diagrams illustrating the relationship between the recesses and protrusions on the surface of the recording material P and the cleaning capability. In these figures, the pressure roller is illustrated at 23, and contaminating toner D adheres to the surface of the pressure roller 23. The recording material P is to be formed into a cleaning sheet, and toner CT is used for the toner image pattern for cleaning. FIG. 4 illustrates a recording material P with small recesses and protrusions. On the other hand, FIG. 5 illustrates a recording material P with large recesses and protrusions. When the recesses and protrusions on the recording material P are small, the toner CT borne on the recording material tightly contacts the contaminating toner D on the pressure roller 23 for cleaning. However, when the recesses and protrusions on the recording material are large, the toner CT borne on the recording material is prevented from tightly contacting the contaminating toner D on the pressure roller 23, and left in a certain area (portion G) without being removed. However, as illustrated in FIG. 6, the increased amount of toner CT in the image pattern C allows the recesses and protrusions on the recording material to be concealed with the toner CT regardless of the recesses and protrusions on the surface of the recording material P. The surface of the recording material is thus smoothed. Consequently, the toner CT tightly contacts the contaminating toner on the pressure roller 23 for cleaning.

Thus, during a time for executing the cleaning mode, the image forming apparatus according to the present exemplary embodiment uses at least two types of color toner to form toner images forming a toner image pattern C on the recording material P so that the toner amount per unit area on the recording material exceeds 100%. In other words, the toner amount per unit area for toner images on the recording material is larger than the maximum amount of toner (100%) that can be placed in the unit area on the recording material in the normal image forming time (monochrome image forming mode) using only the black toner. The toner images forming the toner image pattern C on the recording material P can be formed using at least two types of color toner so that the toner amount per unit area on the recording material exceeds 180%. In other words, the toner amount per unit area on the recording material for a predetermined toner image can be larger than the maximum amount of toner (180%) that can be placed in the unit area on the recording material in the normal image forming time using plural types of color toner (full color image forming mode). The cleaning effect is improved by increasing the amount of toner in the toner image pattern C. However, this increases toner consumption. Thus, the amount of toner in the toner image pattern C may be appropriately set according to the characteristics of the image forming apparatus.

To allow the toner amount to be set as described above, the video controller 101 converts image data into bit map data so that the conversion is different from the one in the normal image forming time and is dedicated to the cleaning mode. The conversion may be such that the toner amount is adjusted to more than 100% or 180%.

<Evaluation 1>

As shown below in (i) and (ii), a cleaning toner image was formed on a recording material. While being pinched and conveyed via the fixing nip portion, the cleaning sheet with the cleaning toner image fixed thereto was heated to clean the fixing portion (pressure roller) (present exemplary embodiment).

(i) The toner image pattern=a combination of magenta toner and black toner, the toner amount per unit area on the recording material: 150%, cleaning frequency: once per 5,000 sheets, and the number of recording materials P used for each cleaning operation: one.

(ii) The toner image pattern=a combination of yellow toner, cyan toner, magenta toner and black toner, the toner amount per unit area on the recording material: 400%, cleaning frequency: once per 5,000 sheets, and the number of recording materials P used for each cleaning operation: one.

As shown below in (iii), (iv) and (v), a cleaning toner image was formed on a recording material. While being pinched and conveyed via the fixing nip portion, the cleaning sheet with the cleaning toner image fixed thereto was heated to clean the fixing portion (pressure roller) (comparative example).

(iii) As is the case with the conventional image forming apparatus, the toner image pattern was formed using only black toner. The toner amount per unit area on the recording material: 100%, cleaning frequency: once per 5,000 sheets, and the number of recording materials P used for each cleaning operation: one.

(iv) As is the case with the conventional image forming apparatus, the toner image pattern was formed using only black toner. The toner amount per unit area on the recording material: 100%, cleaning frequency: once per 5,000 sheets, and the number of recording materials P used for each cleaning operation: five.

(v) As is the case with the conventional image forming apparatus, the toner image pattern was formed using only black toner. The toner amount per unit area on the recording material: 100%, cleaning frequency: once per 500 sheets, and the number of recording materials P used for each cleaning operation: one.

Table 1 shows the endurance test results of the sheet feeding operation in the apparatus over a certain period for the five types of cleaning modes carried out. The recording material P used as a cleaning sheet was OnHig HuiDong paper (manufactured by OnHig).

TABLE 1

| | Toner amount | Cleaning frequency | The number of cleaning recording materials | Contamination of the recording material | Winding jam |
|---|---|---|---|---|---|
| (i) | 150% | Once per 5,000 sheets | One | Found on 70,000th sheet for the first time | Occurred with none of 100,000 sheets |
| (ii) | 400% | Once per 5,000 sheets | One | Found on none of 100,000 sheets | Occurred with none of 100,000 sheets |
| (iii) | 100% | Once per 5,000 sheets | One | Found on 30,000th sheet for the first time | Occurred with 60,000th sheet for the first time |
| (iv) | 100% | Once per 5,000 sheets | Five | Found on 40,000th sheet for the first time | Occurred with 70,000th sheet for the first time |
| (v) | 100% | Once per 500 sheets | One | Found on 60,000th sheet for the first time | Occurred with none of 100,000 sheets |

As shown in Table 1, when the cleaning (i) according to the present exemplary embodiment was carried out, contamination was found on the 70,000th recording material for the first time. However, none of 100,000 sheets were subjected to a winding jam. When the cleaning (ii) according to the present exemplary embodiment was carried out, none of the 100,000 sheets were subjected to contamination of the recording material or a winding jam. On the other hand, when the conventional cleaning (iii) was carried out, contamination was found on the 30,000th recording material for the first time, and a winding jam occurred with the 60,000th sheet for the first time. Furthermore, even with the conventional cleaning method, the cleaning effect can be improved by increasing the number of recording materials used for each cleaning operation. However, the improvement is insignificant compared to an associated increase in the consumption of the recording material. Moreover, even with the conventional cleaning method, an effect similar to that of the cleaning (i) according to the present exemplary embodiment can be exerted by frequently performing the cleaning as in the case of (v). However, in this case, the cleaning needs to be performed 10 times as frequently as in (i).

<Evaluation 2>

Then, as is the case with Evaluation 1, the image forming apparatus according to the present exemplary embodiment was used to produce a cleaning sheet, and the cleaning performance of the cleaning sheet was verified. Table 2 shows the results of the verification in which Fox River Bond paper (manufactured by Fox River Paper Co.; basis weight: 75 g/m$^2$) was used as the recording material P for cleaning. Conditions for the cleaning mode are similar to those in (i) and (ii) in Evaluation 1.

TABLE 2

| | Toner amount | Cleaning frequency | The number of cleaning recording materials | Contamination of the recording material | Winding jam |
|---|---|---|---|---|---|
| (i) | 150% | Once per 5,000 sheets | One | Found on 50,000th sheet for the first time | Occurred with none of 100,000 sheets |
| (ii) | 400% | Once per 5,000 sheets | One | Occurred with none of 100,000 sheets | Occurred with none of 100,000 sheets |

As shown in Table 2, the cleaning capability under the cleaning conditions in (i) was degraded compared to that in Evaluation 1. This is expected to be because the surface of the Fox River Bond brand paper is rougher than that of the OnHig HuiDong brand paper and is thus difficult to tightly contact with the pressure roller surface, which is to be cleaned, thus degrading the cleaning capability. On the other hand, under the cleaning conditions in (ii), more toner is placed on the recording material to conceal the surface characteristics of the recording material. Consequently, the entire toner image can be tightly contacted with the pressure roller surface, which is to be cleaned, thus maintaining the cleaning capability regardless of the type of the recording material.

As described above, the color image forming apparatus according to the present exemplary embodiment exerts a cleaning effect higher than that produced in the conventional mode. The image forming apparatus according to the present exemplary embodiment eliminates the need to use a plurality of recording materials as cleaning sheets and the need to perform frequent cleaning operations.

Therefore, under conditions under which the surface of the fixing roller 22 or the pressure roller 23 is particularly severely contaminated, for example, if a large number of recording materials containing a large amount of calcium carbonate or talc are passed through (introduced into) the nip portion N, the contamination can be eliminated by one cleaning operation. This eliminates the need to use a plurality of recording materials P as cleaning sheets CS and the need to perform frequent cleaning operations. Thus, the present exemplary embodiment enables a reduction in the number of cleaning operations required for the fixing roller 22 or the pressure roller 23, which is to be cleaned.

Exemplary Embodiment 2

Another example of the image forming apparatus will be described.

The color image forming apparatus according to the present exemplary embodiment has the same construction as that of the color image forming apparatus according to Exemplary Embodiment 1 except that a recording material can be conveyed at any one of a plurality of conveyance speeds and that during a time for executing the cleaning mode, the recording material is conveyed at a conveyance speed other than the highest one.

In the present exemplary embodiment, the same members and portions as those of the image forming apparatus according to Exemplary Embodiment 1 are denoted by the same reference numerals and will not be described. This also applies to Exemplary Embodiment 3.

When a toner image pattern C is formed on a recording material P, the image quality of the toner image pattern is negligible. However, in this case, the amount of toner in the unfixed toner image pattern C in the unit area on the recording material P is larger than in a normal image forming mode. Thus, when the conveyance speed at which the recording material is conveyed to form the toner image pattern C on the recording material P is set to the largest value as in the normal image forming time, if in particular, the toner image pattern C is formed in a low-temperature environment, an improper-fixation problem such as a blister may occur. No serious problem occurs when the blister is at such a level so as to prevent the toner from being peeled off unless the top surface of the recording material is rubbed hard. However, if the blister is at such a level which allows the toner to be easily peeled off, any of a fixing device 20 and members conveying the recording material P may unfavorably be contaminated by toner. These problems can be solved by setting a higher fixation temperature. However, a fixing apparatus design for a higher fixation temperature for the cleaning mode, which is only infrequently carried out, unfavorably increases costs.

Furthermore, the conveyance speed at which the recording material P (=cleaning sheet CP) bearing the fixed toner image is conveyed while being pinched by a fixing nip portion N is set to a recording material conveyance speed lower than that in the normal image forming time. Then, even with the surface temperature of a fixing roller 22 unchanged, heat received by the cleaning sheet CP increases by a quantity corresponding to an increase in the time required to pass the cleaning sheet CP through the nip portion N. This promotes the melting of the toner image in the toner image pattern C on the cleaning sheet CP or the contaminating toner on the surface of the fixing roller 22 or a pressure roller 23. A higher cleaning effect can thus be exerted.

Thus, the image forming apparatus according to the present exemplary embodiment sets the recording material conveyance speed for formation of the toner image pattern C on the recording material P (to produce the cleaning sheet CP), to a value smaller than that in the normal image forming mode. Alternatively, the conveyance speed at which the recording material is conveyed with the toner image pattern surface on the recording material P facing the surface of the fixing roller 22, which is to be cleaned (the cleaning sheet CP with the fixed toner image is heated and conveyed while being pinched by the fixing nip portion N) is set to a value smaller than that in the normal image forming mode. Alternatively, both of the following conveyance speeds are set to values smaller than that in the normal image forming mode: the conveyance speed for formation of the toner image pattern C on the recording material P (to produce the cleaning sheet CP), and the conveyance speed at which the recording material is conveyed with the toner image pattern surface on the recording material P facing the surface of the fixing roller 22, which is to be cleaned (the cleaning sheet CP with the fixed toner image is heated and conveyed while being pinched by the fixing nip portion N). That is, during at least one of the operation of forming a toner image pattern on the recording material and the operation of conveying the recording material with the toner image pattern surface on the recording material facing the fixing member, which is to be cleaned, the recording material is conveyed at a conveyance speed other than the highest one. Specifically, the recording material conveyance speed for formation of the toner image pattern on the recording material P can be set to be at most half of that in the normal image forming mode. Furthermore, the recording material conveyance speed at which the recording material is conveyed with the toner image pattern surface on the recording material P facing the surface of the fixing roller 22, which is to be cleaned can be set to be at most half of that in the normal image forming mode. In the present exemplary embodiment, a control portion 100 drivingly controls a fixing motor M so that in the cleaning mode (when the cleaning sheet CP is produced and when the cleaning sheet CP with the fixed toner image is heated and conveyed while being pinched by the nip portion N), the recording material P is conveyed at a conveyance speed lower than that in the normal image forming mode.

When the toner image pattern C was formed on the recording material P (the cleaning sheet CP was produced) at a toner amount of 400% in a 10° C., 50%-RH environment, under conditions for the image forming apparatus according to Exemplary Embodiment 1, the toner was peeled off simply by lightly brushing the surface of the toner image pattern with the hand. Here, the conditions for the image forming apparatus according to Exemplary Embodiment 1 were as follows: the recording material conveyance speed for production of the cleaning sheet CP was 180 mm/sec (the same speed as that in the normal image forming time), and the surface temperature of the fixing roller 22 was 190° C.

In contrast, under conditions for the image forming apparatus set for production of the cleaning sheet CP (the toner amount per unit area was 400%) according to the present exemplary embodiment, the toner was prevented from being peeled off even when the surface of the toner image pattern was rubbed with a plastic piece. Here, the conditions for the image forming apparatus for production of the cleaning sheet CP according to the present exemplary embodiment were as follows: the recording material conveyance speed was 60 mm/sec (one-third of the speed in the normal image forming mode), and the surface temperature of the fixing roller 22 was 180° C.

When the cleaning sheet CP was pinched and conveyed via the nip portion N, none of 100,000 sheets were subjected to contamination of the recording material P or a winding jam under the conditions for the image forming apparatus according to the present exemplary embodiment and under the cleaning conditions in Evaluation 1 (i) according to Exemplary Embodiment 1. That is, compared to Exemplary Embodiment 1, the present exemplary embodiment improved the cleaning effect. Here, the cleaning conditions in Evaluation 1 (i) according to Exemplary Embodiment 1 were as follows: the amount of toner in the unfixed toner image pattern was 150%, the recording material conveyance speed at which the cleaning sheet CP with the fixed toner image was conveyed via the nip portion N was 180 mm/sec (the same speed as that in the normal image forming mode), and the surface temperature of the fixing roller set when the cleaning sheet CP with the fixed toner image was pinched and conveyed via the nip portion N was 190° C. The conditions for the image forming apparatus according to the present exemplary embodiment were as follows: the amount of toner in the unfixed toner image pattern was 150%, the recording material conveyance speed at which the cleaning sheet CP with the fixed toner image was pinched and conveyed via the nip portion N was 60 mm/sec (one-third of the speed in the normal image forming mode), and the surface temperature of the fixing roller set when the cleaning sheet CP with the fixed toner image was pinched and conveyed via the nip portion N was 180° C.

As described above, the sheet conveyance speed of the fixing portion for at least one of the operation of forming a cleaning sheet and the operation in which the fixing portion heats and conveys the cleaning sheet is lower than that in the normal image forming mode. In particular, the recording material conveyance speed for at least one of the operation of forming a cleaning sheet and the operation in which the fixing portion heats and conveys the cleaning sheet is lower than the highest one of the recording material conveyance speeds in the normal image forming mode. Setting the sheet conveyance speed of the fixing portion for formation of a cleaning sheet to be lower than that in the normal image forming mode is effective for preventing the image forming apparatus from being contaminated as a result of the production of a toner image pattern. A high cleaning effect can be exerted by setting the sheet conveyance speed of the fixing portion for the operation in which the fixing portion heats and conveys the cleaning sheet (fixing portion cleaning mode) to be lower than that in the normal image forming time.

Exemplary Embodiment 3

Another example of the color image forming apparatus will be described.

During a time for executing the cleaning mode, the color image forming apparatus shown in the present exemplary embodiment changes transfer conditions under which an unfixed toner image is transferred from an image bearing member to a recording material, from the transfer conditions for normal image formation. Furthermore, during a time for executing the cleaning mode, the color image forming apparatus changes cleaning conditions for a cleaning unit under which the image bearing member from which the unfixed toner image has been transferred is cleaned to remove transfer residual toner, from the cleaning conditions for the normal image formation. Except for these arrangements, the image forming apparatus according to the present exemplary embodiment has the same construction as that of the image forming apparatus according to Exemplary Embodiment 1.

The image quality of the toner image pattern C formed on the recording material P is negligible. However, in this case, the toner amount per unit area on the recording material P for the unfixed toner image pattern C is larger than in the normal image forming mode. Thus, for example, in a construction adopting an intermediate transfer belt 6 as an image bearing member as in the case of the image forming apparatus according to the present exemplary embodiment, the following problems are likely to occur. In the construction adopting the intermediate transfer belt 6, when in a toner transfer step in which a secondary transfer roller 13 transfers toner to the recording material P, the unfixed toner image pattern C is transferred under transfer conditions similar to those for the normal image formation, the transfer may be improper particularly in a humid environment. This prevents a toner image pattern C with an expected toner amount from being formed on the recording material P. Thus, the cleaning effect during a time for executing the cleaning mode may be degraded. On the other hand, the improper transfer of the unfixed toner image pattern C means an increase in the amount of transfer residual toner on the surface of the intermediate transfer belt 6. Thus, a large amount transfer residual toner travels to a collection roller 15 serving as a cleaning unit for the intermediate transfer belt 6. This may result in improper cleaning.

Thus, the present exemplary embodiment changes the conditions for the transfer of the toner from the intermediate belt 6 onto the recording material P and the cleaning conditions for the transfer residual toner on the surface of the intermediate transfer belt 6, from the corresponding conditions for the normal image formation.

An example will be specifically described below according to the construction of the image forming apparatus according to the present exemplary embodiment. During a time for executing the cleaning mode (when the cleaning sheet CP is produced), a transfer bias higher than that applied in the normal image forming mode is applied to a secondary transfer roller 13 by a second transfer bias power source V2. In the normal image forming mode, an excessively high transfer bias inverts the charged polarity of part of the toner from negative to positive. The part of the toner then returns from the recording material P to the intermediate transfer belt 6. This may make the image on the recording material P improper, that is, the image may be partly lost. On the other hand, when the cleaning toner image pattern C is produced, the image quality is negligible. Thus, the transfer bias applied to the secondary transfer roller 13 may be set to such a value which allows the largest amount of toner to be transferred onto the recording material P regardless of whether or not the improper image occurs. That is, the image forming portion has a transfer portion that transfers the toner image to the recording material. Settings for the transfer portion for formation of a cleaning sheet are different from those for the normal image formation.

On the other hand, in the normal image forming mode, the collection roller 15 collects toner during printing of predetermined pages and then collectively electrostatically emits the recovered transfer residual toner onto the surface of the intermediate transfer belt 6. However, the image forming apparatus according to the present exemplary embodiment performs the collection of the transfer residual toner and the electrostatic emission every time the cleaning mode is carried out (every time one page of cleaning sheet is produced). That is, every time the cleaning mode is carried out, the collection roller 15 collects the transfer residual toner on the surface of the intermediate transfer belt 6. Then, the collected transfer residual toner is electrostatically emitted onto the surface of the intermediate transfer belt 6. Furthermore, in the normal image forming mode, the transfer residual toner emitted onto the intermediate transfer belt 6 is reversely transferred only to the photosensitive drum 1Y by a bias applied by a first transfer bias power supply V1Y. In the image forming apparatus according to the present exemplary embodiment, every time the cleaning mode is carried out, predetermined transfer biases are applied to primary transfer rollers 9C, 9M and 9K by first transfer bias power sources V1C, V1M and V1K in the respective image forming stations so as to reversely transfer the toner to downstream photosensitive drums 1C, 1M and 1K. That is, after each cleaning sheet CP is produced, a control portion 100 controls the transfer bias power sources V1C, V1M and V1K so that the predetermined transfer biases are applied to the primary transfer rollers 9Y, 9C, 9M and 9K, respectively, by the transfer bias power sources V1Y, V1C, V1M and V1K. That is, the image forming portion has the toner image bearing member (in the present exemplary embodiment, the intermediate transfer belt 6) bearing the toner image to be transferred to the recording material, and the cleaning portion (corresponding to the collection roller 15 and the four image forming stations according to the present exemplary embodiment) that cleans the toner image bearing member. The settings (a toner emission timing for the collection roller 15 and settings for the four image forming stations for toner collection) for the cleaning portion for formation of a cleaning sheet are different from those for the normal image formation.

Such changes in the settings allow prevention of improper images resulting from the improper cleaning of the intermediate transfer belt 6 after the execution of the cleaning mode, without a reduction in the amount of toner for the unfixed toner image pattern C on the recording material P.

The change in the toner transfer conditions during a time for executing the cleaning mode according to the present exemplary embodiment is applicable to a color image forming apparatus with an endless belt-like electrostatic suction and conveyance transfer belt. In the normal image forming mode, the color image forming apparatus allows the recording material to stick to the outer peripheral surface (surface) of the electrostatic suction and conveyance transfer belt. The color image forming apparatus then circularly moves the electrostatic suction and conveyance transfer belt along a plurality of photosensitive drums serving as an image bearing member. Each of the plurality of photosensitive drums bears a toner image to be formed on the recording material. Then, the transfer biases are applied to the primary transfer rollers (transfer unit), serving as transfer units, to superimposedly transfer the single-color toner images from the photosensitive drums to the recording material on the surface of the electrostatic suction and conveyance transfer belt. The change in the toner transfer conditions for the cleaning mode according to the present exemplary embodiment is applied to the color image forming apparatus, which can then exert the same effects as those of the image forming apparatus according to the present exemplary embodiment.

The color image forming apparatus according to the present exemplary embodiment is based on the scheme in which the collection roller 15 is used to clean the surface of the intermediate transfer belt 6 to remove the transfer residual toner therefrom. The cleaning method is not limited to the one based on the collection roller 15. A blade type cleaning method also allows the application of the change in the conditions for the cleaning mode as in the case of the present exemplary embodiment.

Figure 7:
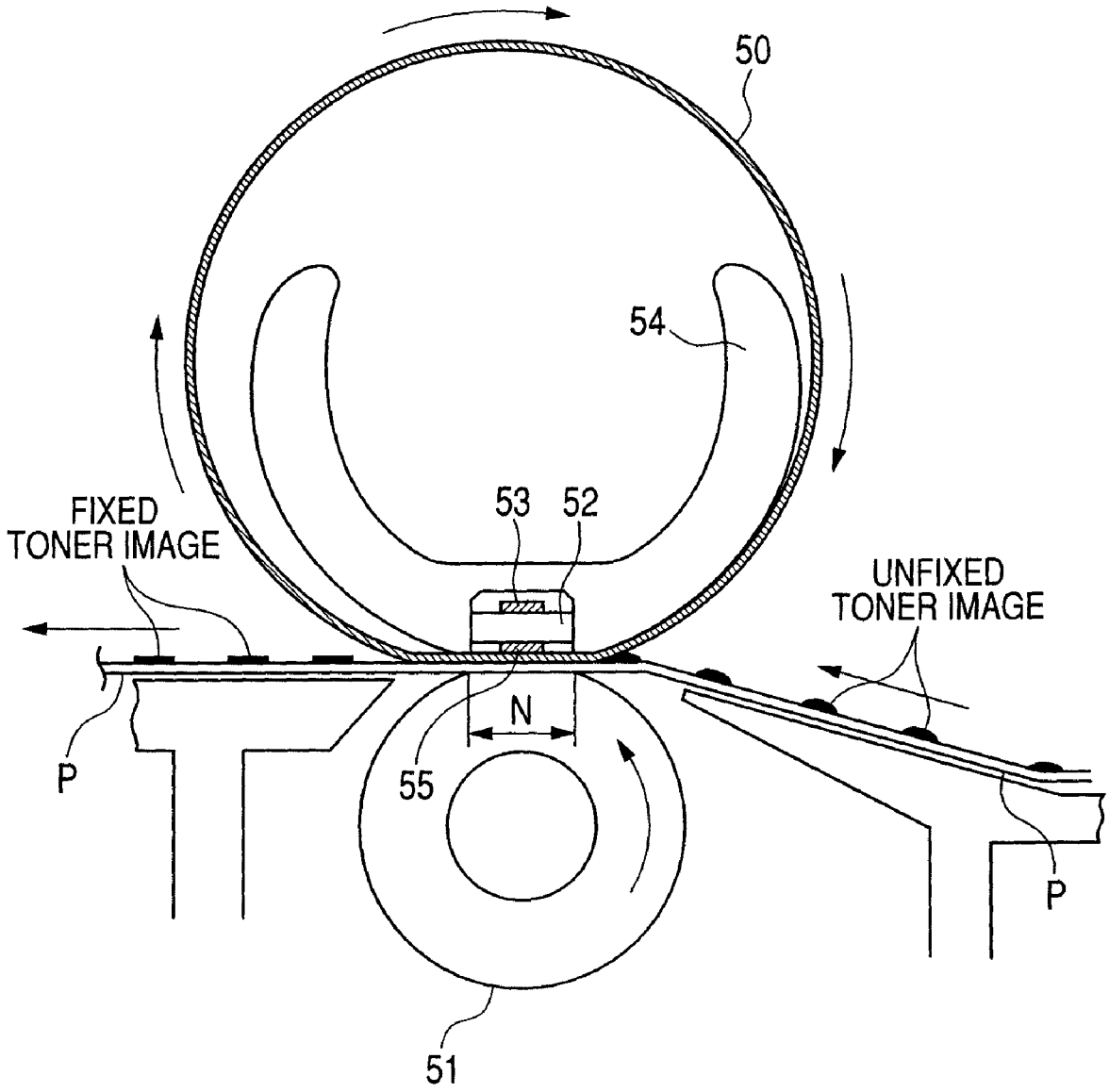
FIG. 7 is a sectional view of a fixing apparatus using an endless belt.

Furthermore, when the cleaning mode is set, not both the application condition and the cleaning condition need to be changed with respect to the settings for the normal image forming mode; the application condition relates to the application of the transfer bias to the secondary transfer roller 13, and the cleaning condition relates to the cleaning of the intermediate transfer belt 6 by the collection roller 15. Changing only one of the conditions is allowed. Furthermore, in the exemplary embodiments, the fixing apparatus has been described in conjunction with the heated roller scheme involving the fixing roller 22, containing the halogen lamp 21, and the pressure roller 23. However, the present invention is applicable to an image forming apparatus including a fixing apparatus having an endless belt 50, a heater (ceramic heater) 52 contacting the inner surface of the endless belt 50, and a backup member (for example, a pressure roller) 51 forming a fixing nip portion N together with the heater 52 via the endless belt 50 as illustrated in FIG. 7. In FIG. 7, a temperature detecting element 53 detects temperature of the heater 52, and a guide member 54 guides rotation of the endless belt 50. A heat resistor 55 is formed on a ceramic substrate in the heater 52. The fixing apparatus controls power supplied to the heat resistor 55 according to the temperature detected by the temperature detecting element 53. During a time for executing the normal image forming mode and during the production of a cleaning sheet in the cleaning mode, the recording material P bearing the unfixed toner image is heated and fixed to the recording material while being pinched and conveyed via the fixing nip portion N. Furthermore, during the conveyance of the cleaning sheet CP in the cleaning mode (in the fixing portion cleaning time), the cleaning sheet CP bearing the fixed toner image (predetermined toner image) is heated while being pinched and conveyed via the fixing nip portion so that the image surface contacts the pressure roller 51.

In particular, the temperature of the fixing apparatus using the endless belt 50 can be raised in a short time so that the fixing apparatus switches from a standby state in which the apparatus waits for a print instruction to a fixation enabled state. Thus, the fixing apparatus need not be preheated during the standby state (even if the preheating is performed, the fixing apparatus has only to be heated so as to maintain very low temperature). Consequently, compared to a fixing apparatus based on the heated roller scheme, the present fixing apparatus has the backup member (pressure roller) 51 the temperature of which during the period in a standby state is lower than that according to the heated roller scheme and it is the case even after printing has been started. The toner is likely to deposit on low-temperature members. With the fixing apparatus using the endless belt, toner is likely to deposit on the pressure roller. Thus, the present invention can be very effectively applied to the image forming apparatus on which the fixing apparatus using the endless belt is provided because the present invention sets the toner amount per unit area for the predetermined toner image (cleaning image) on the recording material to be greater than the maximum amount of toner that can be provided in the unit area on the recording material when the normal image formation is performed using only the black toner. In particular, this effect is enhanced when the toner amount per unit area for the predetermined toner image on the recording material is set to be greater than the maximum amount of toner that can be placed in the unit area on the recording material when the normal image formation is performed using plural types of color toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Laid-Open No. 2008-101396, filed Apr. 9, 2008, and No. 2009-083242, filed Mar. 30, 2009, which are hereby incorporated by reference herein in their entirety.

What is claimed is:

1. A full color image forming apparatus for forming a color toner image on a recording material, comprising:

an image forming portion for forming a full color toner image on a recording material, the image forming portion having a plurality of image forming stations; and a fixing portion that heats and fixes the toner image formed on the recording material to the recording material, wherein said image forming apparatus is capable of setting a cleaning mode for cleaning the fixing portion, and when the cleaning mode is set, at least two image forming stations among the plurality of image forming stations form a predetermined toner image on the recording material, and then the fixing portion heats and fixes the predetermined toner image to the recording material to form a cleaning sheet which is heated and conveyed at the fixing portion to clean the fixing portion, and wherein a toner amount per unit area to form the predetermined toner image on the recording material is larger than a maximum amount of toner per unit area in which the toner is borne on the recording material in a case where a normal black toner image is formed by only using an image forming station for a black color among the plurality of image forming stations.

2. A full color image forming apparatus according to claim 1, wherein the toner amount per unit area for the predetermined toner image on the recording material is larger than a maximum amount of toner per unit area in which the toner is borne on the recording material in a case where a normal full color toner image is formed by using the plurality of image forming stations.

3. A full color image forming apparatus according to claim 1, wherein a sheet conveyance speed of the fixing portion for at least one of an operation of forming the cleaning sheet and an operation in which the fixing portion heats and conveys the cleaning sheet is lower than a sheet conveyance speed of the fixing portion during the time for forming a normal image.

4. A full color image forming apparatus according to claim 1, wherein the image forming portion has a transfer portion transferring the toner image to the recording material, and a set condition for the transfer portion for formation of the cleaning sheet is different from a set condition for normal image formation.

5. A full color image forming apparatus according to claim 1, wherein the image forming portion has a toner image bearing member bearing the toner image to be transferred to the recording material, and a cleaning portion cleaning the toner image bearing member, and a set condition for the cleaning portion for formation of the cleaning sheet is different from a set condition for normal image formation.

6. A full color image forming apparatus according to claim 1, wherein the apparatus further comprises a conveyance path along which the cleaning sheet with the fixed toner image is conveyed to the fixing portion.

7. A full color image forming apparatus according to claim 1, wherein the apparatus further comprises a recording material supply portion that supplies the recording material, and wherein the cleaning sheet with the fixed toner image is conveyed to the fixing portion after set by a user on the recording material supply portion.

8. A full color image forming apparatus according to claim 1, wherein the fixing portion has an endless belt, a heater contacting an inner surface of the endless belt, and a backup member forming a fixing nip potion together with the heater via the endless belt.

9. A method of cleaning a fixing portion provided on a full color image forming apparatus that forms a color toner image on a recording material, the method comprising the steps of:

setting a cleaning mode for cleaning the fixing portion;

forming a predetermined toner image on the recording material by using at least two image forming stations among a plurality of image forming stations;

heating and fixing the predetermined toner image to the recording material to form a cleaning sheet; and heating and conveying the cleaning sheet with the toner image fixed thereto to clean the fixing portion, wherein a toner amount per unit area to form the predetermined toner image on the recording material is larger than a maximum amount of toner per unit area in which the toner is borne on the recording material in a case where a normal black toner image is formed by only using an image forming station for a black color among the plurality of image forming stations.

10. A method according to claim 9, wherein the toner amount per unit area for the predetermined toner image on the recording material is larger than a maximum amount of toner per a unit area in which the toner is borne on the recording material in a case where a normal full color toner image is formed by using the plurality of image forming stations.

* * * * *